US010921088B2

(12) United States Patent
Rentz et al.

(10) Patent No.: US 10,921,088 B2
(45) Date of Patent: Feb. 16, 2021

(54) DOUBLE LOCK CONNECTOR

(71) Applicant: Gregory E. Summers, Madison Heights, VA (US)

(72) Inventors: Marc T. Rentz, Madison Heights, VA (US); Gregory E. Summers, Amherst, VA (US); Tristan Mason, Madison Heights, VA (US)

(73) Assignee: Gregory E. Summers, Madison Heights, VA (US)

( * ) Notice: Subject to any disclaimer, the term of this patent is extended or adjusted under 35 U.S.C. 154(b) by 0 days.

(21) Appl. No.: 16/587,164

(22) Filed: Sep. 30, 2019

(65) Prior Publication Data

US 2020/0370859 A1 Nov. 26, 2020

Related U.S. Application Data

(63) Continuation-in-part of application No. 16/421,589, filed on May 24, 2019.

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/14; F41B 5/1426; F41C 11/00; Y10T 403/32262; Y10T 403/32368; F16C 11/00; F16C 11/10
USPC ..... 124/86, 88, 89; 403/84, 97, 98, 103
See application file for complete search history.

(56) References Cited

U.S. PATENT DOCUMENTS 3,342,172 A * 9/1967 Dewitt ..... F41B 5/1426 124/23.1
3,419,295 A * 12/1968 Small ..... F16C 11/10 403/92
4,054,121 A * 10/1977 Hoyt, Jr. ..... F41B 5/1426 124/89
4,553,522 A * 11/1985 Topping ..... F41B 5/1426 124/89
4,917,343 A * 4/1990 Wainscott ..... A47B 23/06 248/284.1
5,239,977 A * 8/1993 Thomas ..... F41B 5/1426 124/88
5,630,407 A * 5/1997 Gasser ..... F41B 5/1426 124/89
5,934,266 A * 8/1999 Martin ..... F41B 5/1426 124/88

(Continued)

*Primary Examiner* — Alexander R Niconovich
(74) *Attorney, Agent, or Firm* — Leading Edge Law Group, PLC

(57) ABSTRACT

A double locking connector for an archery bow stabilizer includes a base having a tapered end portion and a fitting having a chamber configured to receive the tapered end portion. Two independent locking assemblies are provided to connect the fitting with the base tapered portion to provide a secure connection. The first locking assembly includes a screw which passes through an opening in the fitting for connection with a threaded opening in the tapered portion. The second locking assembly includes interlocking gear teeth provided on the fitting and on a plate connected with the base, respectively. An adjustable rod lock may also be connected with the base to prevent a side bar mount from moving during use of the bow.

14 Claims, 8 Drawing Sheets

(56) References Cited

U.S. PATENT DOCUMENTS 5,992,403 A * 11/1999 Slates ..... F41B 5/1426 124/89
6,205,992 B1 * 3/2001 Meeks ..... F41B 5/14 124/86
6,216,317 B1 * 4/2001 Chen ..... B25G 1/063 16/430
6,568,382 B2 * 5/2003 Martin ..... F16B 21/165 124/25.5
6,957,648 B1 * 10/2005 Adcock ..... F41B 5/1426 124/86
7,367,740 B2 * 5/2008 Lazic ..... F16C 11/10 248/125.1
7,434,773 B1 * 10/2008 Minjares ..... F41A 23/06 124/86
7,464,908 B2 * 12/2008 Files ..... F41B 5/066 124/86
7,958,881 B2 * 6/2011 Silverson ..... F41B 5/1426 124/86
8,347,870 B1 * 1/2013 Mahutga ..... F41B 5/1426 124/89
8,534,273 B2 * 9/2013 LoRocco ..... F41B 5/1426 124/89
8,646,440 B1 * 2/2014 Albanese ..... F41B 5/1426 124/88
8,701,645 B2 * 4/2014 Stokes ..... F41B 5/1426 124/89
8,776,772 B1 * 7/2014 Albanese ..... F41B 5/1426 124/88
8,839,774 B1 * 9/2014 Torbett ..... F41B 5/1453 124/88
8,955,504 B1 * 2/2015 Albanese ..... F41B 5/1426 124/88
9,377,269 B2 * 6/2016 Bidigare ..... F41B 5/10
9,377,270 B2 * 6/2016 Stokes ..... F41B 5/1426
10,240,886 B1 * 3/2019 Huang ..... F41B 5/1426
10,612,881 B2 * 4/2020 Houle ..... F41B 5/066
2013/0291846 A1 * 11/2013 Arndt ..... F41B 5/1453 124/23.1
2014/0060514 A1 * 3/2014 Bidigare ..... F41B 5/1426 124/88
2015/0184973 A1 * 7/2015 Martens ..... F41B 5/00 124/23.1
2019/0025009 A1 * 1/2019 Carpenter ..... F41B 5/1426

* cited by examiner

DOUBLE LOCK CONNECTOR

This application is a continuation-in-part of U.S. patent application Ser. No. 16/421,589 filed May 24, 2019.

BACKGROUND OF THE DISCLOSURE

Professional archers often use a stabilizer with their bow to improve their accuracy. Similarly, hunters may also use a stabilizer as well. A stabilizer is typically screwed into an accessory hole on the bow, whether it by a compound or an Olympic bow. The stabilizer resists torque and absorbs vibrations in the bow when shot, thereby reducing the shock felt in the archer's hand on the bow grip. It also helps keep the bow balanced and settles the archer's arm during aiming.

As a result of the vibrations in the bow, it is not uncommon for stabilizers to come loose and partially disconnect or unscrew from the bow. Not only does this diminish the effectiveness of the stabilizer, but the time and effort required to repeatedly tighten the stabilizer on the bow becomes frustrating to an archer and can distract the archer's concentration.

BRIEF DESCRIPTION OF THE PRIOR ART

In order to improve the connection between a stabilizer and a bow, most stabilizer connectors currently in use include a male and female assembly connection design to lock the stabilizer bar down to the archer's preferred angular position relative to the bow. While current stabilizer connectors operate satisfactorily, the vibrations from the bow still tend to weaken the male/female connector to such an extent that the stabilizer shifts from its preferred angular position.

SUMMARY OF THE INVENTION

The present disclosure describes an improved stabilizer connector which provides greater strength to keep the stabilizer from moving from the preferred position. The connector includes a base having a tapered end portion which is preferably in the shape of a truncated cone. A fitting is also provided which includes a chamber configured to receive the base tapered end portion. A locking assembly clamps the fitting onto the tapered end portion.

In one embodiment, the tapered end portion contains three symmetrical contact surfaces and a threaded opening in the end surface and the locking assembly includes a screw which passes through an opening in the fitting and into the threaded opening of the tapered end of the base. Tightening of the screw clamps the fitting onto the base tapered end portion.

In another embodiment, a second locking assembly is provided for connecting the fitting with the base tapered end portion independent of the first locking assembly. The second locking assembly includes a locking pin having a first end portion which engages an outer surface of the base tapered end portion and a second end portion which is arranged in a channel in the fitting which extends parallel to the axis of the fitting. The end surface of the second end portion of the locking pin includes a threaded opening. A second screw is arranged in the fitting channel and is threadably connected with the threaded opening of the locking pin. When the second screw is rotated in the locking direction, the locking pin first end portion is pressed against the base tapered end portion outer surface and a surface of the fitting which defines the fitting chamber is pressed against the base tapered end portion outer surface.

The base tapered end portion contains an annular recess in its outer surface in a region of the tapered end portion remote from the tapered end portion end surface. The locking pin first portion is pressed into the annular recess when the second screw is rotated in the locking direction.

In a further embodiment, the fitting includes a plurality of teeth on outer surface and the second locking assembly includes a toothed plate. The fitting is positioned relative to the base tapered end as desired by the user and the plate is then connected with the base tapered end, with the teeth of the plate interlocking with the teeth of the plate.

According to yet another object of the invention, the base includes a recess or dovetail extending from the tapered end to the opposite end. A locking rod includes a projection which is slidably arranged in the dovetail. A ball is arranged in the projection with a portion of the ball extending from an opening in a bottom surface of the projection. A screw passes through the dead stop projection presses against the ball to press the ball against the bottom surface of the dovetail to lock the dead stop in a selected location along the length of the base.

BRIEF DESCRIPTION OF THE FIGURES

Other objects and advantages of the connector will become apparent from a study of the following specification when viewed in the light of the accompanying drawing, in which.

DETAILED DESCRIPTION

Figure 1:
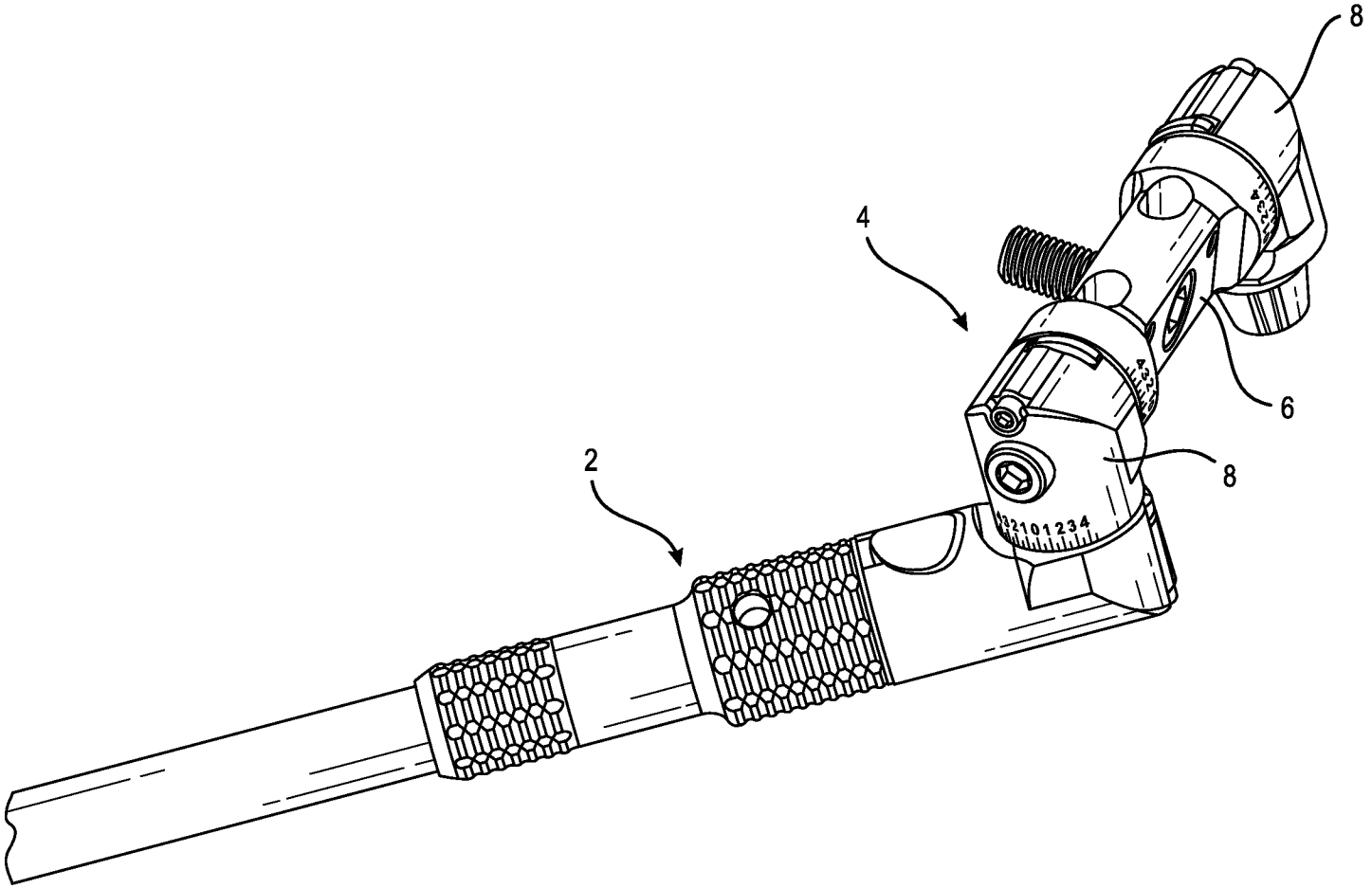
FIG. 1 is a front perspective view of a first embodiment of a connector for an archery bow stabilizer.

In FIG. 1 is shown a stabilizer 2 for an archery bow and a connector 4 for connecting the stabilizer to the bow (now shown). The connector 4 is actually a dual connector. That is, it includes a base 6 with a fitting 8 mounted on each end of the base.

Figure 2:
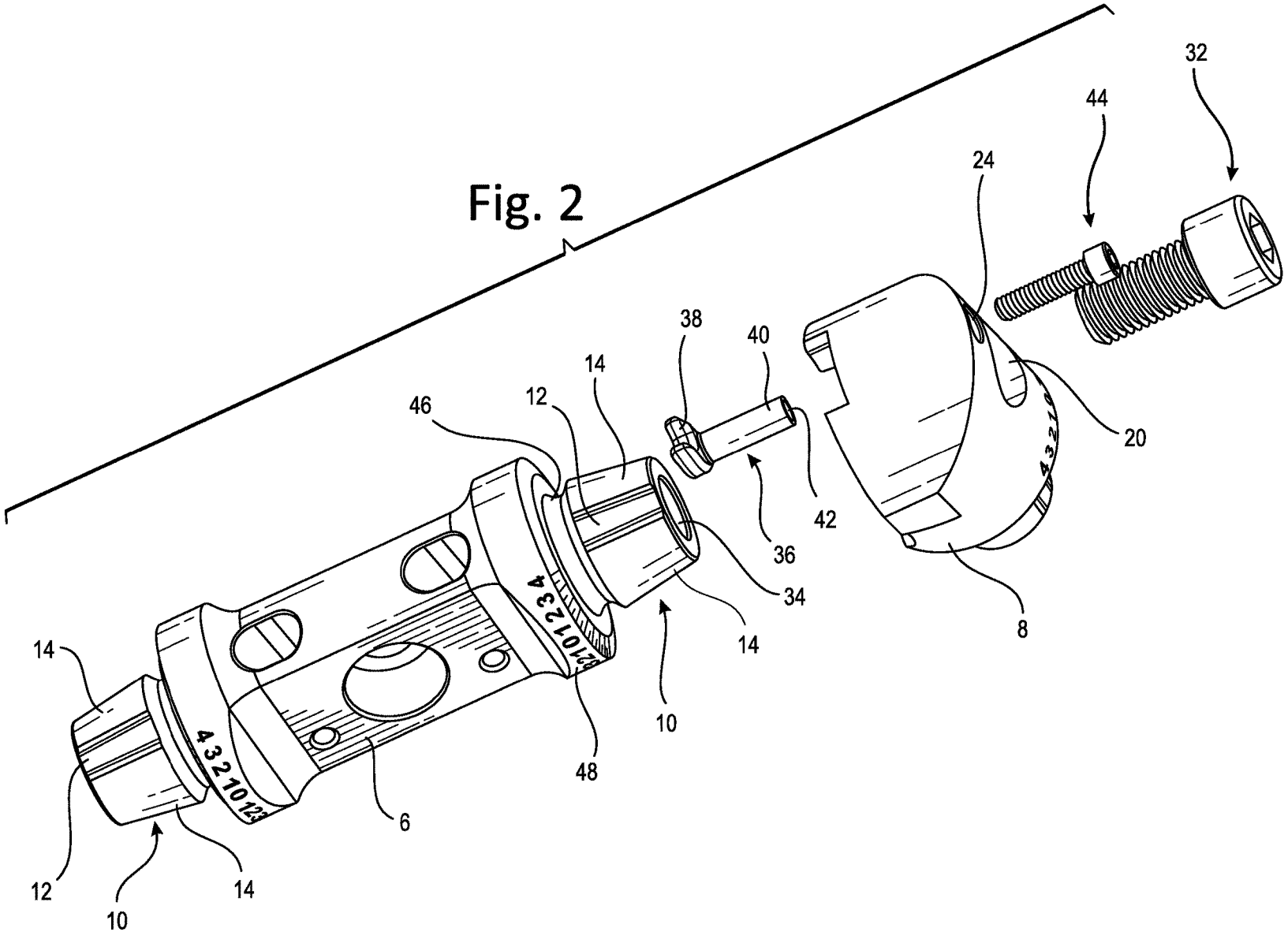
FIG. 2 is an exploded perspective view of the connector of FIG. 1.

The components for the connector are shown in more detail in FIGS. 2-5. Referring first to FIG. 2, the base 6 is shown with an elongated configuration having tapered end portions 10. It will be readily appreciated by those of ordinary skill in the art that the base may have other configurations, for example an L-shaped configuration, and may have any number of tapered portions at various locations on the base. The tapered portions are generally in the form of a truncated cone. As will be developed in greater detail below, the outer surface of each tapered portion contains an elongated recess 12 which extends parallel to the axis of the tapered portion and preferably from end-to-end within the outer surface. Preferably, a plurality of recesses is provided in each tapered end, the recesses being equally radially spaced around the circumference of the tapered end. According to a preferred embodiment, three recesses are provided, each spaced by 120°. The recesses thus define contact surfaces 14 for each tapered end portion. The contact surfaces are preferably smooth and flat.

Figure 4:
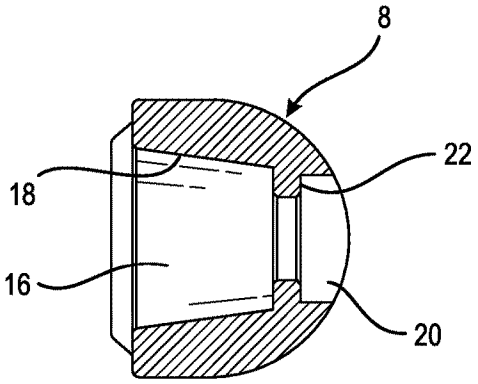
FIG. 4 is a sectional view of the fitting of FIG. 3 taken along line 4-4.
Figure 3:
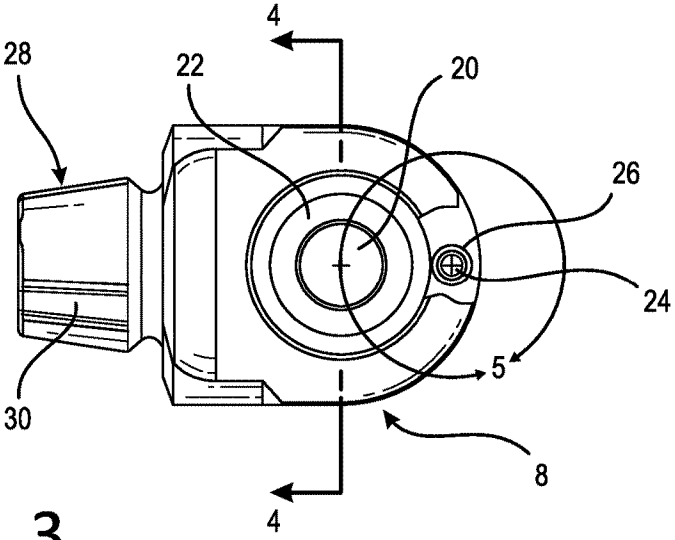
FIG. 3 is a bottom view of a fitting of the connector.
Figure 5:
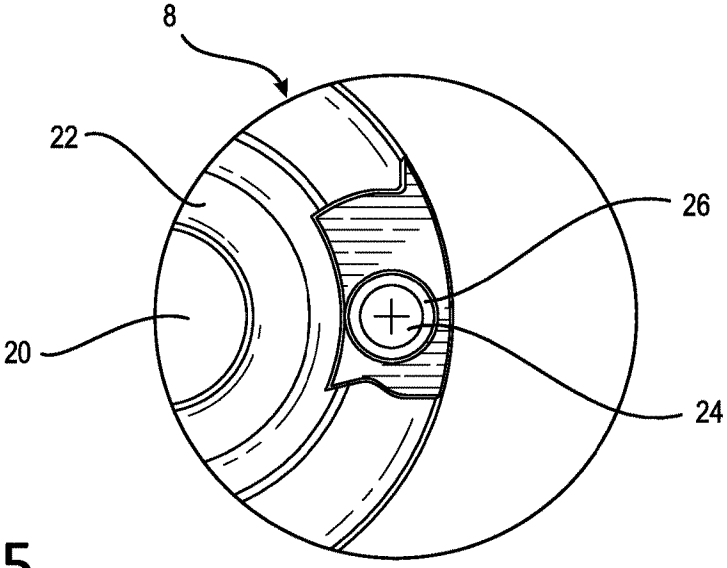
FIG. 5 is an enlarged view of a portion of the fitting of FIG. 3 taken along line 5-5.

The connector fitting 8 is shown in more detail in FIGS. 3-5. Each fitting contains a chamber 16 for receiving a tapered end portion of the base. As shown in FIG. 4, the chamber is defined by an inner surface 18 of the fitting which is configured with the same taper as the tapered end portion 10 of the base. A through opening 20 is provided in each fitting along an axis of the chamber as shown in FIGS. 3 and 4. A recessed seat 22 is provided in the fitting surrounding the through opening. A channel 24 is also provided in each fitting. The channel extends parallel to the through opening. A recessed seat 26 is provided in the fitting surrounding the channel. A tapered extension 28 may also be provided on the fitting for connection with another archery component (not shown) if desired. The extension also contains one or more recesses 30 in the outer surface thereof, the recesses preferably extending continuously from end-to-end of the extension.

A first locking assembly connects the fitting with the base. More particularly, the first locking assembly includes a threaded screw 32 which passes through the first through opening 20 of the fitting. The head of the screw rests against the seat 22. The tapered end portion 10 of the base includes a threaded opening 34 (FIG. 2) which receives the screw 32. Rotation of the screw 32 in a locking direction clamps the fitting onto the tapered end portion as will be discussed below.

In order to further clamp the fitting 8 on the tapered end portion 10 of the base of the connector, a second locking assembly is provided. The second locking assembly is independent of the first locking assembly. It includes a locking pin 36 having a first end portion 38 which engages the outer surface of the tapered end portion and a second end portion 40 which is arranged in the fitting channel 24. The end surface of the locking pin second end portion contains a threaded opening 42. The second locking assembly includes a threaded screw 44 which passes into the fitting channel for connection with the threaded opening 42 of the locking pin 36.

As shown in FIG. 2, each tapered end portion 10 of the base contains an annular recess 46 in a region remote from the tapered end portion end surface. The first portion 38 of the locking pin 36 is pressed into the annular recess when the second screw is rotated in the locking direction.

The assembly of the connector will be described with reference to FIGS. 6*a*, 6*b*, 7*a*, and 7*b*. The locking pin 36 is arranged in the channel 24 of the fitting 8 and the screw 44 is loosely connected with the pin to retain it in the fitting. The fitting is placed over the tapered end portion 10 of the base with the lock pin toggled to a position where the first portion 38 of the lock pin disengaged from the annular recess 46. More particularly, the radius of the lock portion first pin varies to provide clearance from the widest portion of the tapered portion during insertion of the tapered portion into the fitting chamber as shown in FIGS. 6*a* and 6*b*.

Figure 6B:
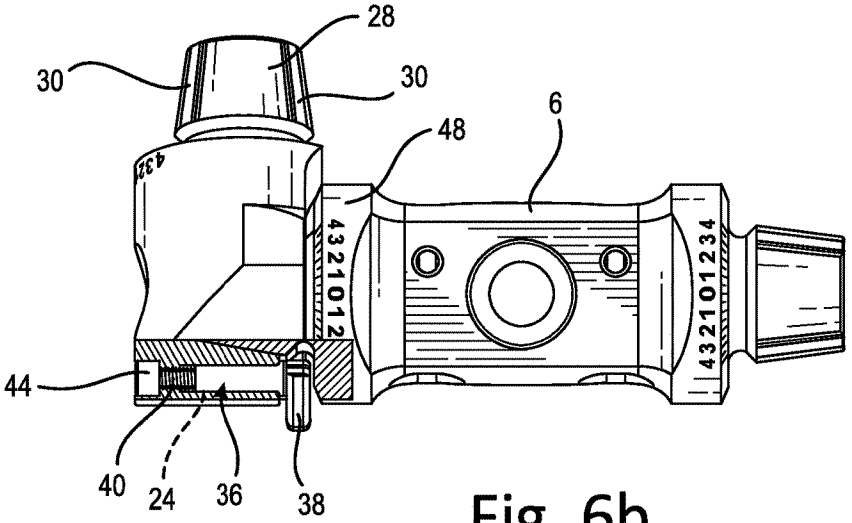
FIGS. 6*a* and 6*b* are a partially cutaway end view and a partially cutaway side view, respectively, of the connector of FIG. 2 showing a locking pin in an unlocked position for disassembly of the connector.
Figure 7B:
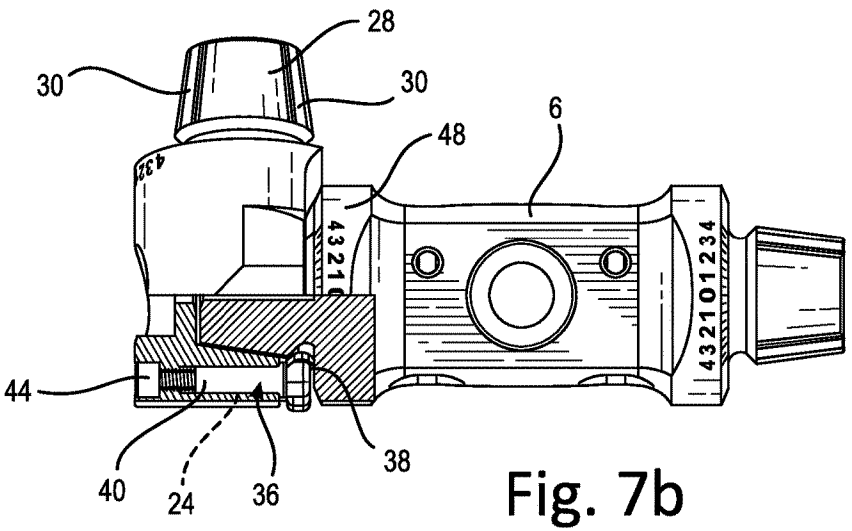
FIGS. 7*a* and 7*b* are a partially cutaway end view and a partially cutaway side view, respectively, of the connector of FIG. 2 showing the locking pin in a locked position.
Figure 6A:
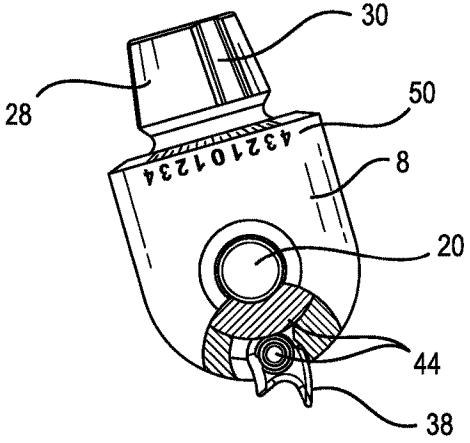
Figure 7A:
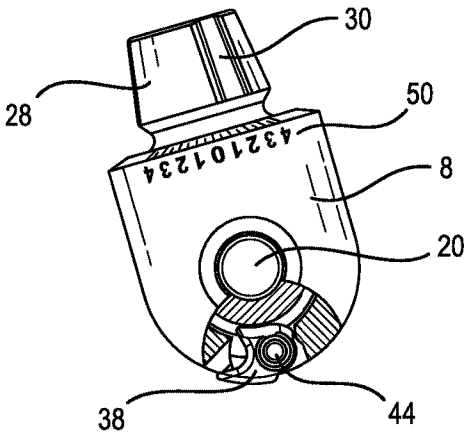

With the fitting loosely mounted on the base tapered end portion as shown in FIGS. 6*a* and 6*b*, the fitting may be rotated relative to the base to control the positioning of an accessory such as a stabilizer for a bow to meet the preferences of the archer. A scale 48 is provided on the base to assist with positioning of the fitting. Similarly, a scale 50 is provided on the fitting where the fitting also is provided with a tapered portion 28. With the fitting properly oriented on the base, the locking pin is toggled to insert the first portion 38 of the locking pin into the annular recess of the base tapered end portion as shown in FIGS. 7*a* and 7*b*. The screw 44 is rotated in the locking direction. Because the head of the screw abuts against the seat 26 surrounding the end of the channel 24, the locking pin is drawn toward the screw so that the first portion 38 of the locking pin presses against the surface of the annular recess of the tapered end portion.

Figure 8A:
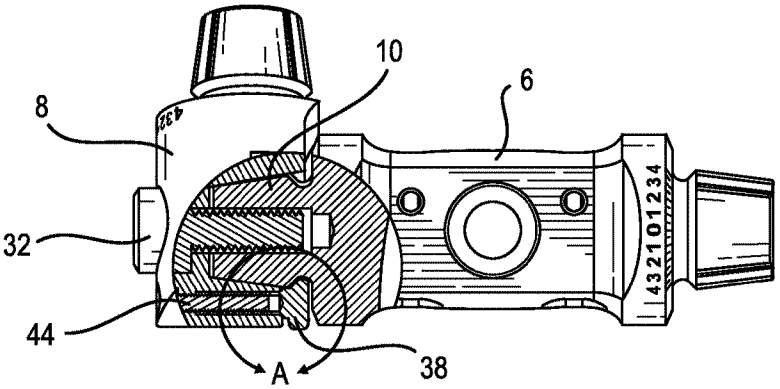
FIG. 8*a* is a partially cutaway side view of the connector of FIG. 2 in the locked position.
Figure 8B:
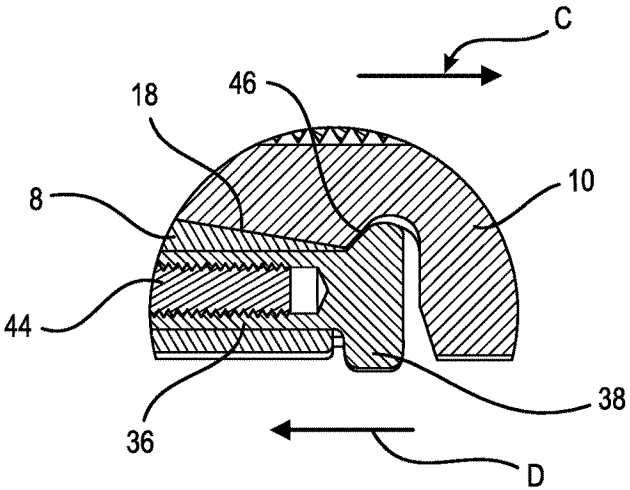
FIG. 8*b* is a detailed view of a portion of FIG. 8*a* taken along line A-A of FIG. 8*a;*

To complete the assembly of the connector, the screw 32 of the first locking assembly is inserted through the opening 20 in the fitting and connected with the threaded opening 34 of the tapered end portion 8 as shown in FIGS. 8*a* and 8*b*. As the screw 32 is rotated in the locking direction, the fitting is pressed against the tapered end portion of the base. More particularly, the inner wall surface 18 of the fitting chamber is pressed against the contact surfaces 14 of the tapered end portion 8 as shown by the arrow C. Where three contact surfaces are provided, the locking forces are evenly distributed about the tapered end portion. In addition to the locking operation of the screw 32 of the first locking assembly, the screw 44 of the second locking assembly when rotated in the locking direction draws the locking pin in the direction shown by the arrow D to further engage the first end portion 38 of the locking pin against the surface defining the annular recess 46 of the tapered end portion. Accordingly two locking forces in opposite directions are provided for a double lock connection between the base and the fitting owing to the first and second locking assemblies. This provides a superior connection in the connector assembly.

Figure 9A:
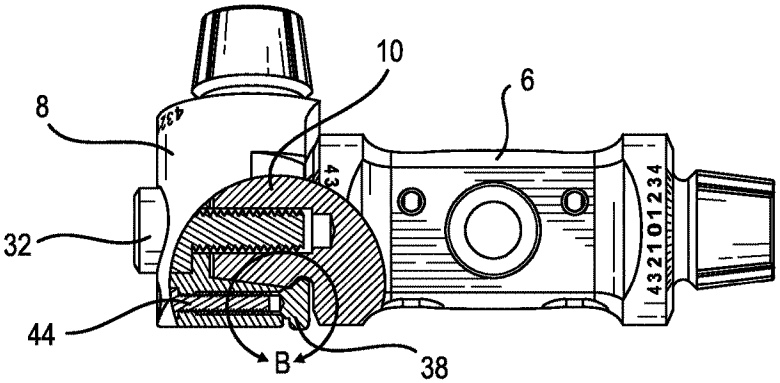
FIG. 9*a* is a partially cutaway side view of the connector of FIG. 2 in the locked position.
Figure 9B:
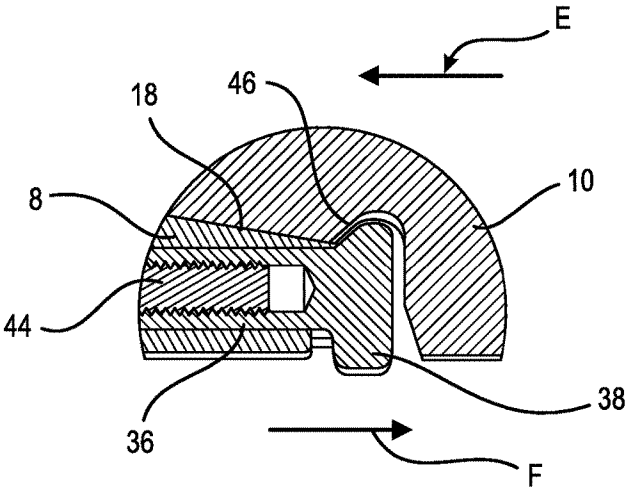
FIG. 9*b* is a detailed view of a portion of FIG. 9*a* taken along line B-B of FIG. 9*a;*

The unlocked condition of the connector is shown in FIGS. 9*a* and 9*b*. When the locking screw 32 is rotated in the unlocking direction, the fitting moves in the direction of the arrow E of FIG. 9*b* to disengage the fitting inner surface 18 from the contact surfaces 14 of the tapered end portion. Similarly, when the screw 44 is rotated in the unlocking direction, the locking pin 36 moves in the direction of the arrow F of FIG. 9*b* to disengage the first portion 38 of the locking pin from the surface of the annular recess 46.

Figure 10:
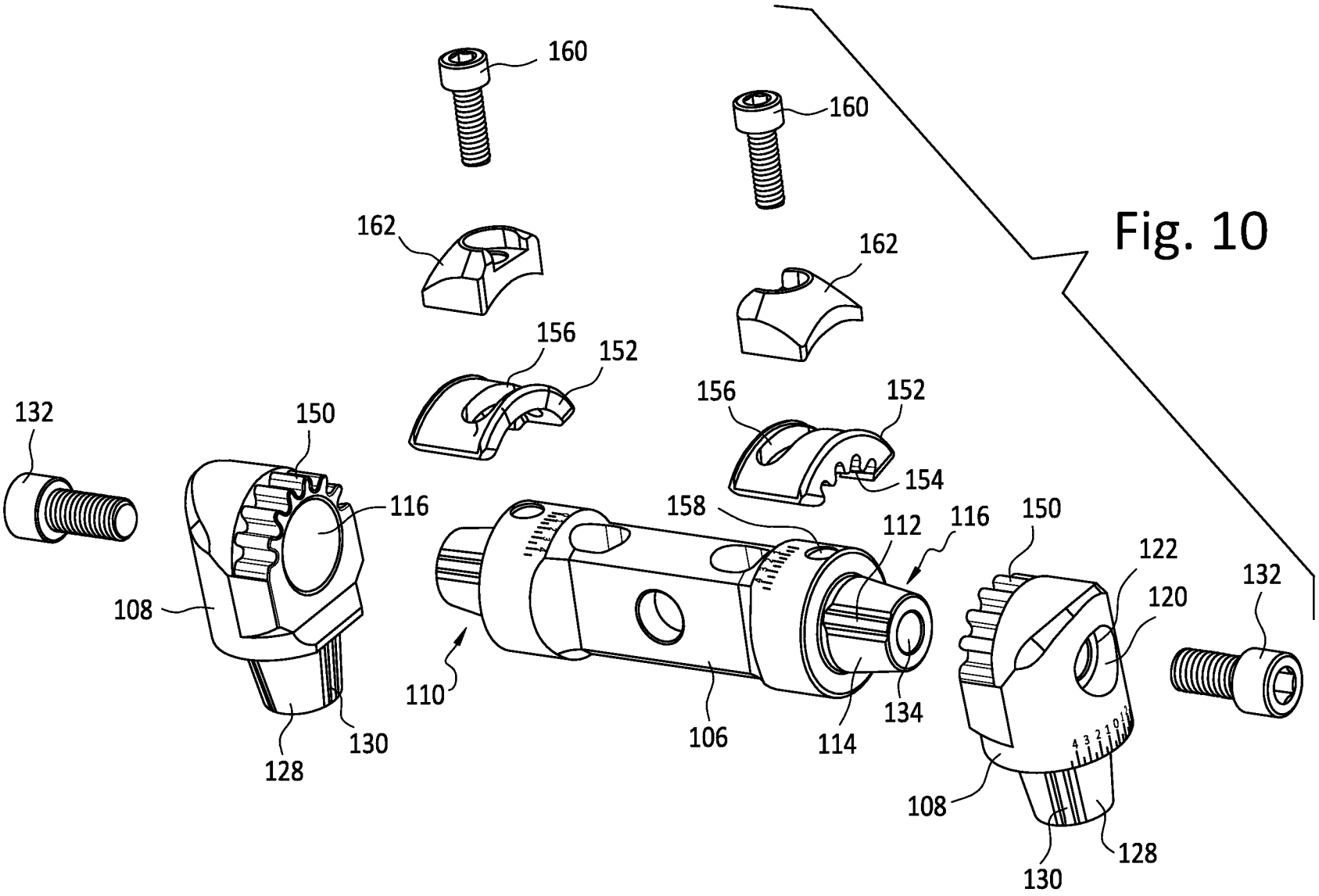
FIG. 10 is an exploded perspective view of a second embodiment of a connector for an archery bow stabilizer.

Turning now to FIG. 10, an alternate embodiment of a connector for connecting a stabilizer with a bow will be described. As in the embodiment of FIGS. 2-5, the connector includes a base 106 having tapered or conical end portions 110. The outer surface of each tapered portion contains an elongated recess 112 which extends parallel to the axis of the tapered portion and preferably from end-to-end within the outer surface. Preferably, a plurality of recesses is provided in each tapered end, the recesses being equally radially spaced around the circumference of the tapered end. The recesses define contact surfaces 114 for each tapered end portion.

The connector fitting 108 contains a chamber 116 for receiving a tapered end portion of the base in a manner similar to that as described above with reference to FIGS. 2-5. A through opening 120 is provided in each fitting along an axis of the chamber. A recessed seat 122 is provided in the fitting surrounding the through opening. A tapered extension 128 may also be provided on the fitting for connection with another archery component (not shown) if desired. The extension also contains one or more recesses 130 in the outer surface thereof, the recesses preferably extending continuously from end-to-end of the extension.

A first locking assembly connects the fitting with the base. More particularly, the first locking assembly includes a threaded screw 132 which passes through the first through opening 120 of the fitting. The head of the screw rests against the seat 122. The tapered end portion 110 of the base includes a threaded opening 134 which receives the screw 132. Rotation of the screw 132 in a locking direction clamps the fitting onto the tapered end portion.

In order to further clamp the fitting 108 on the tapered end portion 110 of the base of the connector, a second locking assembly independent of the first locking assembly is provided. As distinguished from the fitting 8 of the first embodiment shown in FIG. 2, the fitting 108 includes a plurality of gear teeth 150 which are arranged on an outer surface of the fitting. The second locking assembly includes a plate 152 which is removably connected with the base 106 adjacent the tapered end portion 110. The plate includes a plurality of gear teeth 154 which interlock with the teeth of the fitting 108 when the plate is connected with the base. The plate contains a slot 156 and the base includes a threaded opening 158. A threaded screw 160 passes through the slot of the plate and into the threaded opening 158 of the base to clamp the plate 152 against the fitting 108 with the gear teeth interlocked. An optional clamp 162 may also be provided between the screw and the plate to further lock the plate in position when the screw is rotated the locking direction.

The locking connector assembly in the embodiment of FIG. 10 provides a stronger locking force which prevents movement of the stabilizer during use of a bow with which the stabilizer is connected. The pattern of the gear teeth on the plate and the fitting is circumferential which prevents the fitting from being lifted off of the base for adjustment. Rather, when the first and second locking assemblies are unlocked, the fitting must be slid off of the base tapered end portion, repositioned with the teeth aligned, and then slid back on the base tapered portion in a different position. The slot 156 in the plate 152 affords limited adjustment of the plate to accurately align the teeth of the fitting 108 and the plate so that they interlock when the fitting is slid back on the based tapered portion. The screw 132 is tightened to secure the mated fitting and base and then the screw 160 is tightened to fasten the plate 152 which insures that there is no movement of the fitting relative to the base. The second locking assembly essentially anchors the fitting in place.

Figure 11:
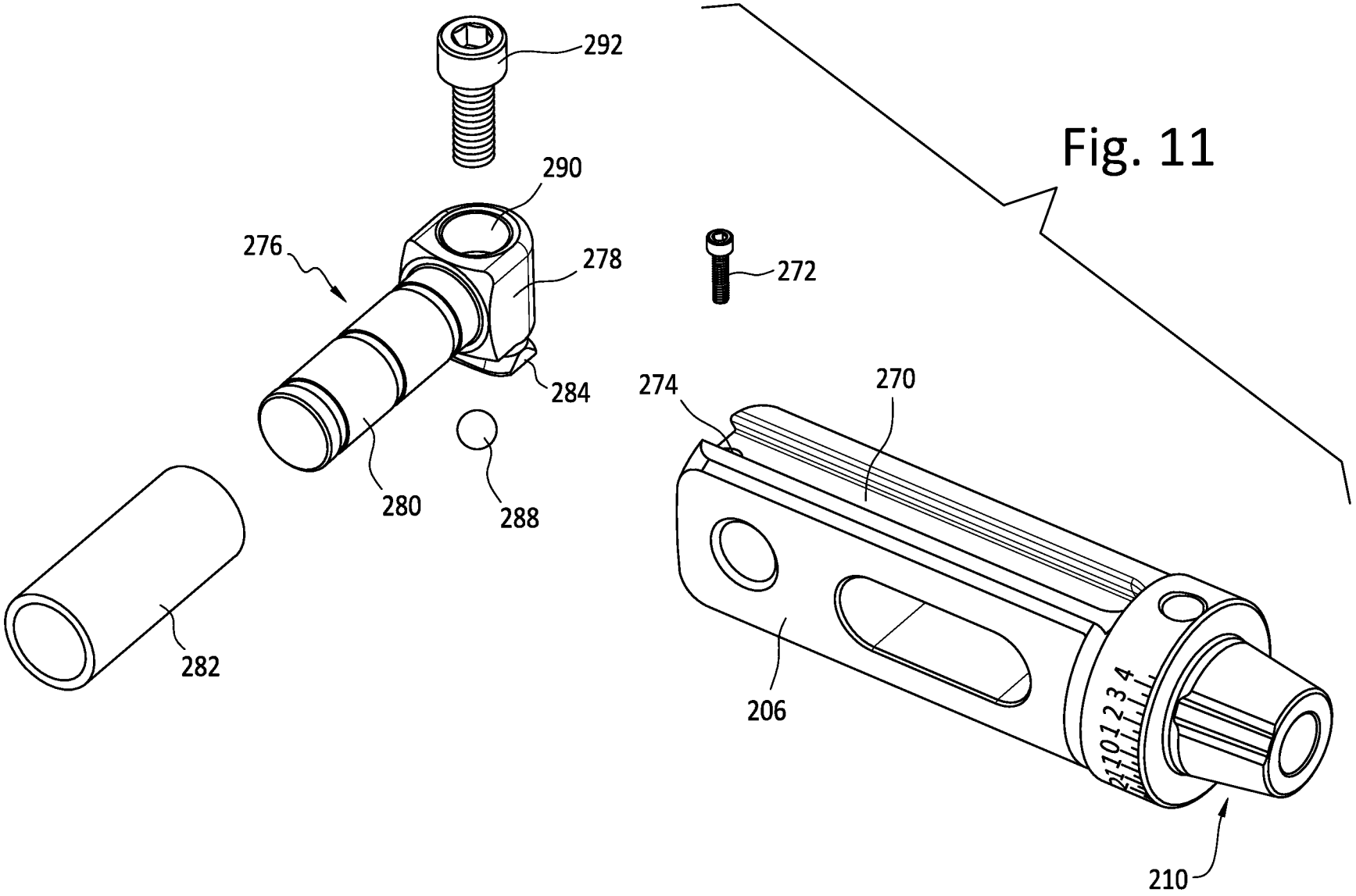
FIG. 11 is an exploded perspective view of an alternate base configuration for the connector and of a locking rod.

Referring now to FIG. 11, there is shown an alternate embodiment of a base 206 for the archery stabilizer connector. The base includes a tapered portion 210 only at one end. The central portion of the base contains a recess, and preferably a dovetail recess 270, which extends from the tapered end to the opposite end of the base. A screw 272 is adapted for connection with a threaded opening 274 in a bottom wall of the dovetail adjacent to the end of the base opposite the tapered end. Other recesses such as a channel or opening may be used in lieu of the dovetail.

Figure 12:
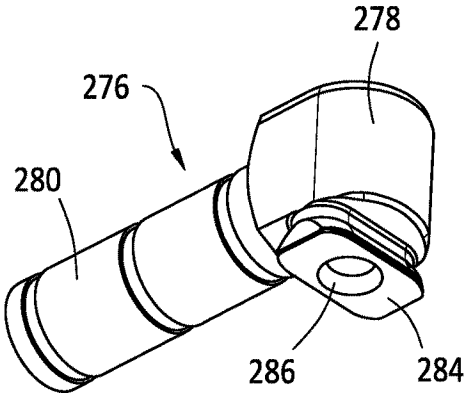
FIG. 12 is a bottom perspective view of the locking rod of FIG. 11.

Also shown in FIG. 11 as well as FIG. 12 is a dead stop or rod lock 276 which is connected with the base 206 of the connector to prevent movement within the connector assembly during use. The rod lock includes a head portion 278 and an extension portion 280. A sleeve 282 is adapted to fit over the extension portion. As shown more particularly in FIG. 12, a projection 284 is connected with the head portion of the rod. The projection is contoured to fit within the dovetail and to be retained by the side and top walls which define the dovetail. More particularly, with the screw 272 removed, the projection is inserted in the free end of the dovetail. The screw 272 is connected with the base and the head portion of the screw prevents the projection from exiting the end of the dovetail. The projection contains a chamber and a first opening 286 communicating with the chamber. A ball 288 is arranged within the projection chamber, and a portion of the ball is configured to extend through the first opening. However, the diameter of the ball is greater than the diameter of the first opening so that the ball is prevented from exiting the chamber.

The head portion 278 of the rod lock contains a threaded opening 290 which further extends through the projection 284 into the chamber therein. A screw 292 is connected with the threaded opening.

When the projection of the rod lock is arranged within the dovetail and with the screw 292 in an unlocked position, the projection and rod lock may be displaced within the dovetail to a desired location. Rotation of the screw in the locking direction displaces the screw into the head portion and into the projection chamber so that the free end of the screw engages the ball. Further rotation of the screw in the locking direction presses the ball against the bottom surface of the dovetail to lock the rod lock in the desired location. The ball is preferably formed of nylon or other material which flexes or compresses to provide a sufficient grip on the bottom surface of the dovetail.

The rod lock is preferably positioned to make contact with the side of the riser of the bow. When the dovetail is arranged upwardly, the rod lock makes contact with the far side of the riser allowing the back bar to be mounted farthest away from the riser. When the dovetail is arranged or mounted downwardly, the rod lock contacts the near side of the riser on the same side as the back bar. The rod lock contacts the riser and keeps the connector assembly from swiveling due to the gravitational pull on the weights mounted on the stabilizer. The rod lock thus keeps the back stabilizer bar with weights mounted thereon from moving during use of the bow to provide a more secure mounting assembly.

Figure 14:
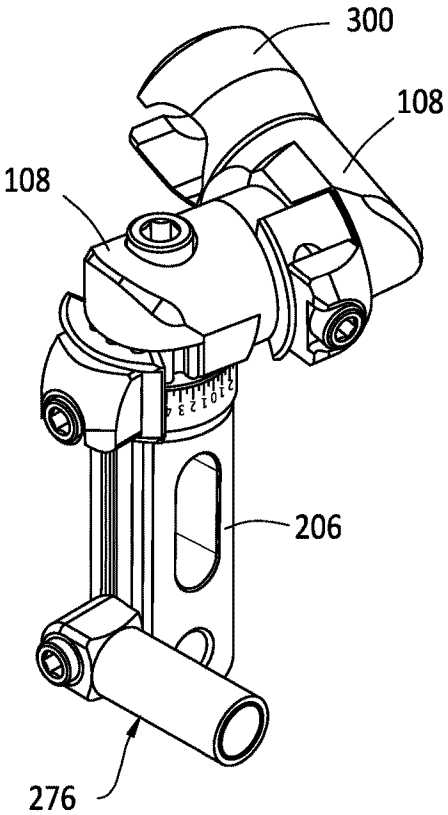
FIGS. 13 and 14 are front and rear perspective views, respectively, of a connector and locking rod in an assembled condition.
Figure 15:
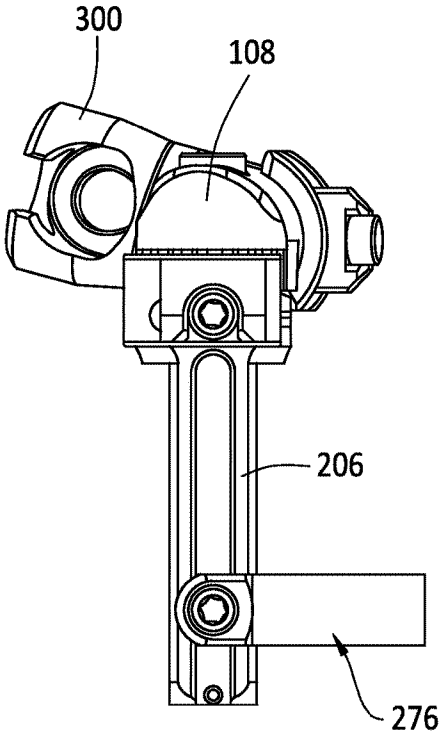
FIG. 15 is a front plan view of the connector and locking rod of FIGS. 13 and 14.
Figure 13:
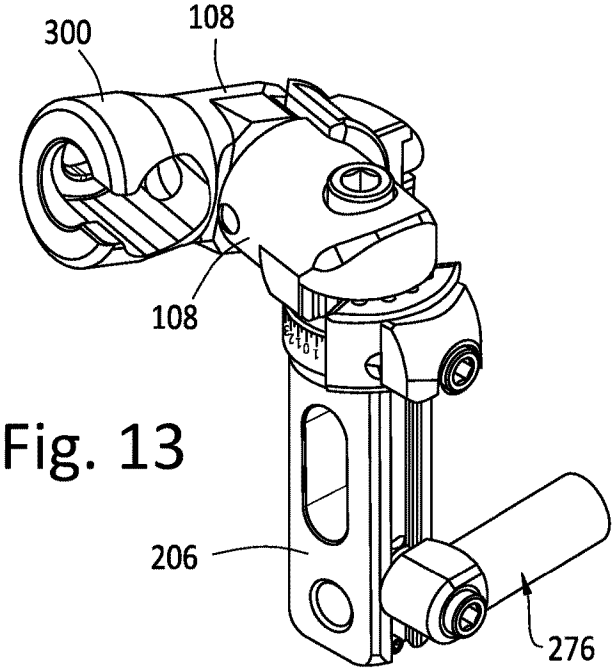

FIGS. 13-15 are different views of the archer bow connector using the base 206 from FIG. 11 with a first toothed fitting 108 and plate 152 of FIG. 10 and the rod lock of FIGS. 11 and 12. A second toothed fitting 108 is connected with the tapered extension (not shown) of the first toothed fitting and a further lock connector 300 is connected with the tapered extension of the second toothed fitting. It will be appreciated that the components of the connector of FIGS. 13-15 are all adjustable to increase the versatility of the connector and satisfy the needs of the user, all which maintaining structural integrity and minimizing vibrations within the assembly.

While the preferred forms and embodiments of the archery stabilizer tube have been illustrated and described, it will be apparent to those of ordinary skill in the art that various changes and modifications may be made without deviating from the novel concepts thereof.

What is claimed is:

1. A connector, comprising (a) abase having an end portion having a conical configuration and a radially smooth contact surface;

(b) a fitting containing a chamber configured to receive, said base end portion, a portion of an outer surface of said fitting containing a plurality of teeth;

(c) a first locking assembly for connecting said fitting with said base end portion; and (d) a second locking assembly for connecting said fitting with said base end portion independent of said first locking portion, said second locking assembly including a plate removably connected with said base adjacent said end portion, said plate including a plurality of teeth which interlock with said teeth of said fitting when said plate is connected with said base.

2. A connector as defined in claim 1, wherein said plate contains a slot, and further wherein said second locking assembly includes a screw which passes through said slot for corm on with a threaded opening in said base adjacent said end portion, said screw being rotated in a locking direction to clamp said plate against said base, said slot affording a limited degree of movement of said plate relative to said base when said screw is rotated in an unlocking direction to unlock said second locking assembly.

3. A connector as defined in claim 2, wherein said second locking assembly further comprises a clamp arranged between said plate and a head of said screw to further lock said plate in position when said screw is rotated in the locking direction.

4. A connector as defined in claim 1, wherein said base end portion contains a threaded opening in an end surface thereof, said first locking assembly including a screw which passes through an opening in said fitting and is connected with said threaded opening.

5. A connector as defined in claim 1, wherein said radially smooth contact surface comprises a flattened surface extending from a free end of said end portion toward said base.

6. A connector as defined in claim 5, wherein said base end portion contains three flattened surfaces spaced equally about a perimeter of said base end portion, thereby to define three contact surfaces of said base end portion within said fitting chamber for mating with a surface of said fitting which defines said fitting chamber.

7. A connector as defined in claim 1, wherein said fitting and plate teeth comprise gear teeth.

8. A connector, comprising (a) a base having an end portion having a conical configuration, an outer surface of said end portion containing three symmetrical radially smooth contact surfaces;

(b) a fitting containing a chamber configured to receive said base end portion, a portion of an outer surface of said fitting, containing a plurality of teeth; and (c) a locking assembly for clamping said fitting onto said radially smooth contact surfaces, said locking assembly including a plate removably connected with said base adjacent said end portion, said plate including a plurality of teeth which interlock with said teeth of said fitting when said plate is connected with said base.

9. A connector for an archery bow mounting assembly, comprising (a) an elongated base having a first end portion having a conical configuration, a radially smooth contact surface, and contains a recess;

(b) a fitting containing a first chamber configured to receive said base first end portion;

(c) a locking, assembly for clamping said fitting onto said first end portion of said base; and (d) a rod connected with said base recess to prevent movement within the mounting assembly during use.

10. A connector as defined in claim 9, wherein said recess comprises at least one of an opening, a slot, and a dovetail.

11. A connector as defined in claim 10, wherein said recess comprises a dovetail extending from said first end to an opposite end of said base.

12. A connector as defined in claim 11, wherein said rod includes a projection at one end which is configured for positioning and retention within said dovetail.

13. A connector as defined in claim 12, wherein said projection contains a second chamber and a first opening communicating with said second chamber, and further comprising a ball arranged in said second chamber, a portion of said ball extending through said first opening.

14. A connector as defined in claim 13, wherein said rod and said projection contain a threaded, opening communicating with said second chamber and arranged opposite said first opening, and further comprising a screw connected with said threaded opening, one end of said screw engaging said ball, whereby rotation of said screw in a locking direction presses said ball against a bottom surface of said dovetail to lock said rod in a selected location along said base.

* * * * *